US006558131B1

(12) United States Patent
Nash, Jr.

(10) Patent No.: US 6,558,131 B1
(45) Date of Patent: May 6, 2003

(54) LIQUID RING PUMPS WITH AUTOMATIC CONTROL OF SEAL LIQUID INJECTION

(75) Inventor: David H. Nash, Jr., Trumbull, CT (US)

(73) Assignee: nash_elmo industries, l.l.c., Trumbull, CT (US)

( * ) Notice: Subject to any disclaimer, the term of this patent is extended or adjusted under 35 U.S.C. 154(b) by 0 days.

(21) Appl. No.: 09/896,628

(22) Filed: Jun. 29, 2001

(51) Int. Cl.[7] ..... F04C 19/00
(52) U.S. Cl. ..... 417/68; 417/53; 417/63
(58) Field of Search ..... 417/68, 69, 18, 417/43, 44.2, 44.3, 46, 54, 313, 440, 53, 63

(56) References Cited

U.S. PATENT DOCUMENTS 3,289,918 A 12/1966 Adams ..... 230/79
4,087,208 A * 5/1978 Uda et al. ..... 417/54
4,260,335 A * 4/1981 Marchal ..... 417/68
4,359,313 A * 11/1982 Bernald ..... 417/68
4,545,730 A * 10/1985 Lubke ..... 417/68
4,655,688 A * 4/1987 Bohn et al. ..... 417/18
4,692,101 A * 9/1987 Fink et al. ..... 417/68
5,366,348 A * 11/1994 Skelton ..... 417/68

* cited by examiner

*Primary Examiner*—Charles G. Freay
*Assistant Examiner*—Han L Liu
(74) *Attorney, Agent, or Firm*—Fish & Neave; Robert R. Jackson; Kevin T. Roddy

(57) ABSTRACT

A liquid ring pump system includes structure configured to automatically and actively vary the amount of seal liquid injected into the sweep of the pump (in order to boost gas discharge pressure) based on one or more variable operating parameters of the pump.

22 Claims, 3 Drawing Sheets

LIQUID RING PUMPS WITH AUTOMATIC CONTROL OF SEAL LIQUID INJECTION

BACKGROUND OF THE INVENTION

This invention relates to liquid ring pumps, and more particularly to controlling the flow of seal liquid injection into the "sweep" portion of such pumps.

Liquid ring pumps are well known, as is shown, for example, by Adams U.S. Pat. No. 3,289,918 (which is hereby incorporated by reference herein in its entirety). The Adams patent shows that it is known that the compression ratio of a liquid ring pump can be increased by injecting additional seal liquid into the liquid ring in the pump at an appropriate location between the gas intake and gas discharge of the pump (i.e., in the so-called "sweep" of the pump). However, the known means for introducing such pressurized seal liquid tend to have fixed flow characteristics. This can be a disadvantage when certain operating conditions of the pump change and/or when certain changes are made in the operating configuration of the pump.

In view of the foregoing, it is an object of this invention to provide improved liquid ring pumps.

It is a more particular object of the invention to provide liquid ring pumps with improved seal liquid injection arrangements.

SUMMARY OF THE INVENTION

These and other objects of the invention are accomplished in accordance with the principles of the invention by providing liquid ring pumps with seal liquid injection that is actively controlled based on at least one operating parameter of the pump. For example, the seal liquid may be supplied from a pressurized source via a variable flow control valve. At least one operating condition of the pump (e.g., seal liquid injection pressure) is monitored to provide information for controlling the amount by which the variable flow control valve is opened. Valve control structure is provided for using that information to open the valve by an amount appropriate to the current pump operating condition information. For example, if seal liquid injection pressure is the pump operating condition being monitored, the seal liquid flow control valve may be controlled to maintain a desired seal liquid injection pressure. Other examples of pump operating conditions or parameters that may be monitored in order to provide alternative or additional information for control of the seal liquid flow control valve include pump speed, gas inlet pressure and/or temperature, and gas discharge pressure and/or temperature. Control may be based on monitoring multiple operating parameters. For example, both gas inlet pressure and gas discharge pressure may be monitored to allow control to be based on the gas pressure differential at which the pump is operating. In that example, the seal liquid flow control valve may be controlled to be closed or open relatively little when the gas pressure differential is low, and to be open to a greater degree when the gas pressure differential is higher.

Among the advantages of using the present invention are that it helps to prevent liquid ring pumps from stalling, and that it otherwise improves the operating stability of such pumps. It also facilitates the use of external seal liquid sources. Such sources tend to have a constant pressure, which can be too high for the liquid ring pumps under some operating conditions, such as during start-up. However, because the present invention provides for active control of the pressure of seal liquid injected into the pump, a seal liquid source having a constant pressure can now be used without difficulty.

Further features of the invention, its nature and various advantages will be more apparent from the accompanying drawings and the following detailed description of the preferred embodiments.

DETAILED DESCRIPTION OF THE PREFERRED EMBODIMENTS

Figure 1:
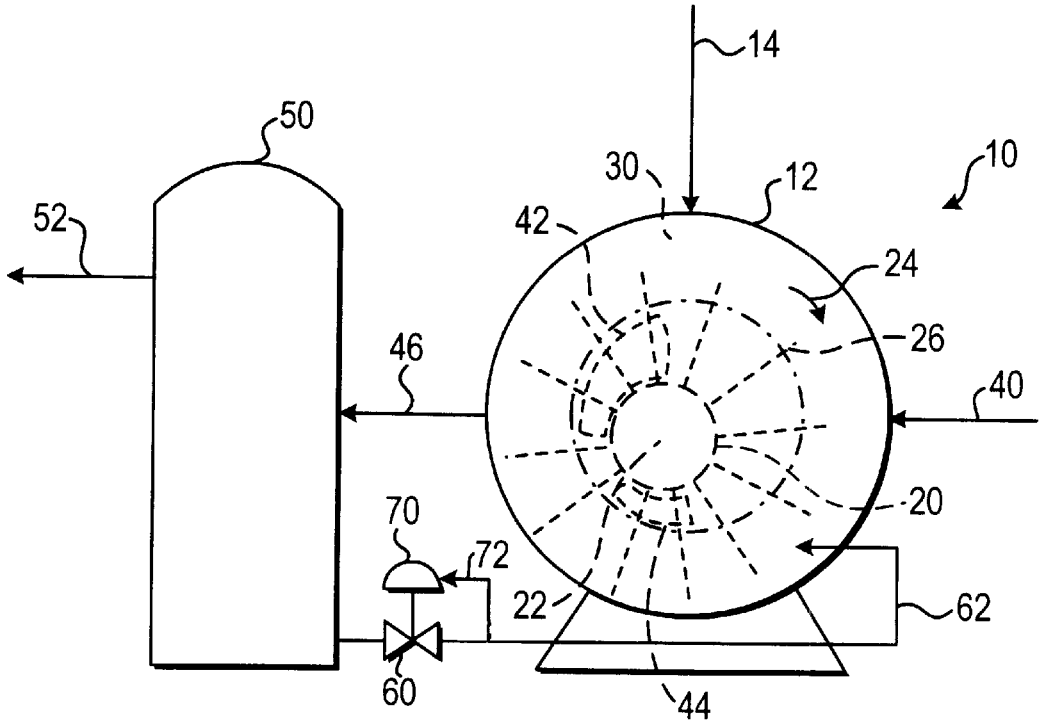
FIG. 1 is a simplified, partly schematic view of an illustrative liquid ring pump installation in accordance with the invention.

The illustrative liquid ring pump installation shown in FIG. 1 includes liquid ring pump 10 and separator 50. Liquid ring pump 10 includes a stationary, hollow, annular housing or casing 12, within which rotor 20 is mounted for rotation about axis 22 in the direction indicated by arrow 24. Rotor 20 includes a plurality of blades 26 equally spaced from one another around axis 22. Each blade 26 extends radially out and axially along relative to axis 22. A quantity of pumping or seal liquid 30 is maintained in housing 12 and is formed into a recirculating ring inside the housing by rotation of rotor 20. The approximate inner surface of this seal liquid ring is indicated by the chain-dotted line in FIG. 1. Rotor 20 is eccentric to housing 12 and therefore also eccentric to the liquid ring recirculating in the housing.

Gas to be pumped is supplied to pump 10 via gas inlet conduit 40. This gas enters the working space of the pump via inlet port 42. Inlet port 42 is located where the chambers bounded by adjacent rotor blades 26 and the inner surface of liquid ring 30 are increasing in size in the direction 24 of rotor rotation. Accordingly, these expanding chambers pull gas to be pumped into the pump.

After passing beyond inlet port 42, the chambers enter the so-called "sweep" portion of the pump and then begin to get smaller again. Where the chambers are decreasing in size, the gas in those chambers is compressed. When the gas has been sufficiently compressed, the chambers begin to communicate with discharge port 44, via which the compressed gas exits the working space of the pump. From discharge port 44 the compressed gas exits the pump via discharge conduit 46. Some seal liquid also typically exits the pump with the compressed gas.

Conduit 46 conveys the compressed gas and seal liquid to separator 50. Separator 50 separates the gas from the liquid and allows the gas to exit the depicted components via conduit 52. At least some of the seal liquid from separator 50 is fed back into pump 10 via variable flow control valve 60 and conduit 62. In particular, conduit 62 feeds this seal liquid back into liquid ring 30 in the sweep area of the pump, where it has the effect of increasing the volume of the liquid ring and thereby boosting the pressure of the gas discharged via discharge elements 44, 46, and 52. Any net loss of seal liquid from the components shown in FIG. 1 is made up from seal liquid supply conduit 14.

Considering the feedback of seal liquid via elements 60 and 62 in more detail, the pressure for forcing this seal liquid to flow back into the sweep of pump 10 comes from the pressure of the compressed gas in separator 50. Variable flow control valve 60 controls the amount or rate of this flow. The amount by which valve 60 is opened at any given time is controlled by valve control structure 70. Structure 70 may be any suitable structure that is appropriate to the (1) type of mechanism used for valve 60, (2) the type of information supplied for control, and (3) any other desired considerations such as the speed and precision with which it is desired to control the valve. In the example shown in FIG. 1, the pressure of the seal liquid in conduit 62 is monitored as indicated by sensor line 72 to provide information for use by valve control structure 70 to control valve 60. Seal liquid pressure in conduit 62 is an indication of pressure (liquid and gas) in the sweep area of the pump to which conduit 62 is connected.

In an illustrative mode of operating the system shown in FIG. 1, elements 60, 70, and 72 are configured to control valve 60 to maintain a predetermined, desired, substantially constant seal liquid pressure in conduit 62 (at least after pump 10 has been in operation long enough to have passed through a start-up period). If the seal liquid pressure in conduit 62 falls below the desired constant pressure, that is sensed by sensor 72, and control 70 responds by increasing the amount by which valve 60 is open. This increases the flow of seal liquid into the sweep of the pump via conduit 62, thereby restoring pressure in the sweep to the desired constant value. Conversely, if the seal liquid pressure in conduit 62 rises above the desired pressure, that is sensed by sensor 72, and control 70 responds by decreasing the amount by which valve 60 is open. This decreases the flow of seal liquid into the sweep of the pump, thereby lowering pressure in the sweep to the desired value. In this way, the seal liquid pressure in conduit 62 is held substantially constant, despite possible changes, for example, in gas inlet pressure in conduit 40. Maintaining the seal liquid pressure in conduit 62 constant helps to give pump 10 a constant gas discharge pressure (in conduit 46/50/52), which may be desirable in many applications.

Figure 2:
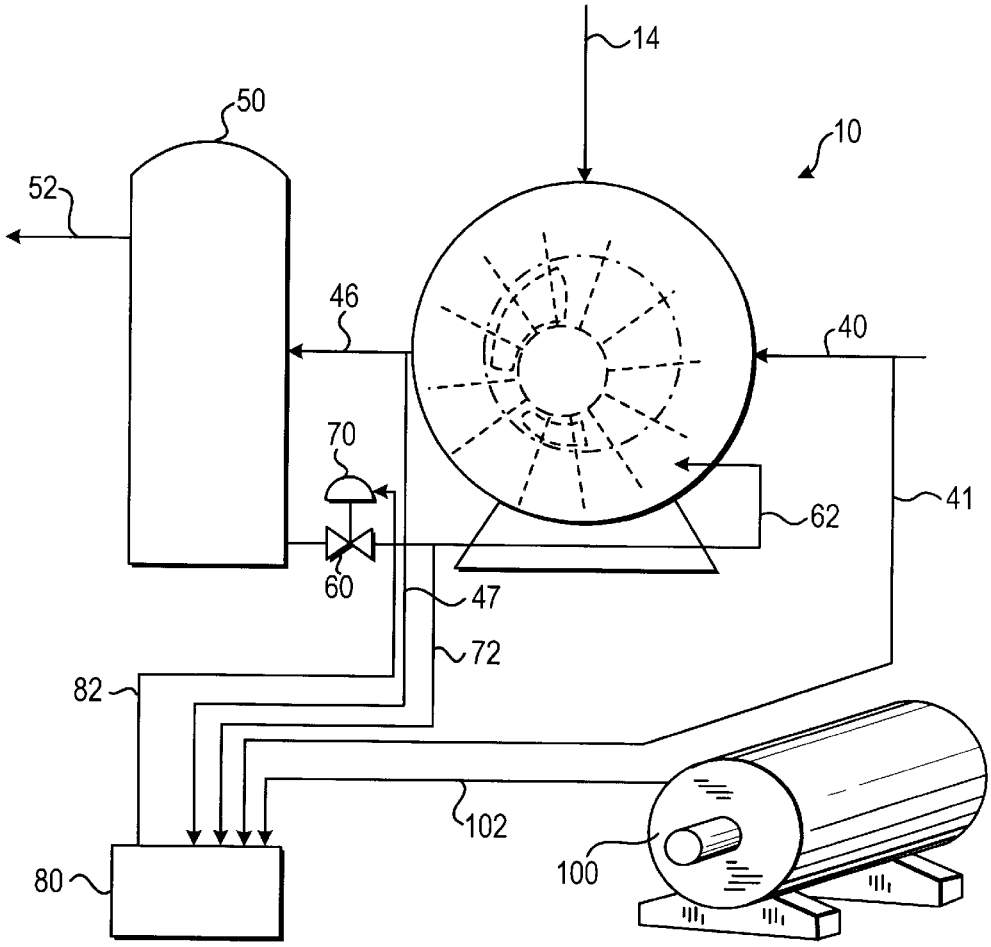
FIG. 2 is similar to FIG. 1, but shows another illustrative liquid ring pump installation in accordance with the invention.

Basing control of valve 60 on the pressure of the seal liquid in conduit 62 is only one example of how valve 60 may be controlled. FIG. 2 shows another illustrative embodiment in which more operating parameters of the pump are monitored and are therefore available for use in determining how much valve 60 should be opened. In the embodiment shown in FIG. 2 valve control structure 70 also includes information processor 80. Information processor 80 may include any number of sensor inputs, such as sensor input 102 (indicating the speed of the motor 100 provided for rotating the rotor in pump 10), sensor input 41 (indicating the pressure and/or temperature of the gas in pump inlet conduit 40), sensor input 47 (indicating the pressure and/or temperature of the gas in discharge conduit 46, and sensor input 72 (described earlier in connection with FIG. 1). Processor 80 processes the information from any or all of such sensor inputs to produce an output 82 for causing control 70 to open valve 60 by the amount determined (by processor 80) to be appropriate for the current operating condition(s) of pump 10. For example, processor 80 may include a suitably programmed microprocessor. Processor 80 may follow a predetermined algorithm, using information from the above-mentioned sensors as inputs, in order to best control valve 60 in view of the current operating conditions of the system.

As just some illustrations of how processor 80 in FIG. 2 may respond to certain conditions, low motor 100 speed (corresponding to low pump 10 speed), low gas pressure differential between conduits 40 and 46, and/or very low or very high seal liquid pressure in conduit 62 may be taken to indicate that pump 10 is just beginning to operate and that the amount by which valve 60 should be open is relatively small or even zero. On the other hand, higher motor 100 speed (corresponding to higher pump 10 speed), high gas pressure differential between conduits 40 and 46, and/or seal liquid pressure in conduit 62 that is neither excessively high nor excessively low may be taken to indicate that pump 10 is ready for valve 60 to be opened by a greater amount.

Figure 3:
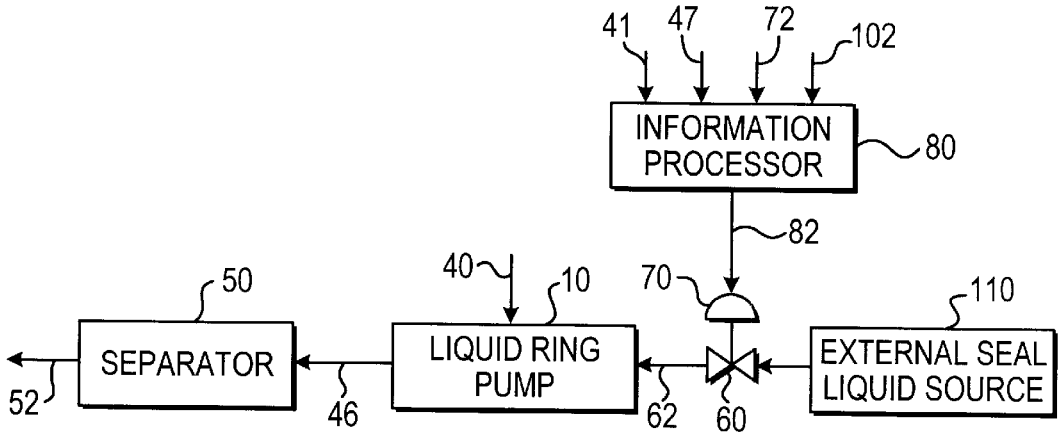
FIG. 3 is a simplified block diagram showing another illustrative embodiment of a system generally like the FIG. 2 system in accordance with the invention.

It will be understood that the foregoing is only illustrative of the principles of the invention, and that various modifications can be made by those skilled in the art without departing from the scope and spirit of the invention. For example, those skilled in the art will appreciate that the invention is equally applicable to liquid ring pumps having many different, otherwise known constructions, such as pumps with flat, conical, or cylindrical port structures. The invention is also applicable to pumps having multiple lobes. It is applicable to single- and double-ended pumps. It is applicable to any stage of multi-stage pumps. If desired, the seal liquid fed or fed back to the liquid ring pump may be cooled (e.g., by passing it through a heat exchanger). The source of pressurized seal liquid for injection into the sweep of the pump does not have to be a separator as shown in the drawings. Seal liquid from any other suitable source can be used instead if desired. As was mentioned in the above Summary section, the seal liquid source can be an external source having a constant pressure, even though that pressure would (without the present invention) be too high for the pump under some or even all operating conditions. FIG. 3 shows a system that can be basically similar to the system shown in FIG. 2, except that in FIG. 3 the seal liquid for injection into liquid ring pump 10 comes from an external seal liquid source 110, which, as has been mentioned, can have a constant pressure.

What is claimed is:

1. A liquid ring pump comprising:

a housing adapted to contain a quantity of seal liquid;

a rotor rotatably mounted in the housing for engaging the seal liquid and causing it to form a ring inside the housing, with the housing, the seal liquid, and the rotor cooperating to define a sweep portion of the pump in which an inner surface of the ring is radially relatively far from an axis of rotation of the rotor as compared to another portion of the pump where the inner surface of the ring is radially relatively close to the axis of rotation of the rotor; and means for introducing seal liquid into the sweep portion of the pump at a rate that is actively controlled for variation based on a variable operating parameter of the pump.

2. The liquid ring pump defined in claim 1 wherein the operating parameter is selected from the group consisting of pressure of the seal liquid introduced by the means for introducing seal liquid, pressure of gas inlet to the pump, pressure of gas discharged by the pump, operating speed of the pump, temperature of gas inlet to the pump, temperature of gas discharged by the pump, and combinations thereof.

3. The liquid ring pump defined in claim 1 wherein the means for introducing seal liquid into the sweep portion of the pump at a rate that is actively controlled for variation comprises a variable liquid flow control valve.

4. The liquid ring pump defined in claim 1 further comprising:

sensor means for sensing the operating parameter.

5. A system comprising:

the liquid ring pump defined in claim 1; and a separator means for separating gas discharged by the pump from seal liquid discharged by the pump.

6. The system defined in claim 5 wherein the means for introducing seal liquid uses seal liquid separated by the separator.

7. The system defined in claim 6 wherein the means for introducing seal liquid comprises:

a seal liquid conduit from the separator to the sweep portion of the pump; and adjustable valve means for controlling seal liquid flow in the conduit.

8. The system defined in claim 7 wherein the means for introducing seal liquid further comprises:

sensor means for sensing the operating parameter of the pump; and valve control means responsive to the sensor means for adjusting the adjustable valve.

9. A liquid ring pump, comprising:

a housing adapted to contain a quantity of seal liquid;

a rotor rotatably mounted in the housing for engaging the seal liquid and causing it to form a ring inside the housing, with the housing, the seal liquid, and the rotor cooperating to define a sweep portion of the pump in which an inner surface of the ring is radially relatively fat from an axis of rotation of the rotor as compared to another portion of the pump where the inner surface of the ring is radially relatively close to the axis of rotation of the rotor; and variable flow control means for controlling a rate of flow of seal liquid injection into a sweep portion of the pump from outside a working space of the pump based on a variable operating parameter of the pump.

10. The liquid ring pump defined in claim 9 wherein the operating parameter is selected from the group consisting of pressure of the seal liquid injected by the variable flow control means, pressure of gas inlet to the pump, pressure of gas discharged by the pump, operating speed of the pump, temperature of gas inlet to the pump, temperature of gas discharged by the pump, and combinations thereof.

11. The liquid ring pump defined in claim 9 wherein the variable flow control means comprises:

an adjustable valve.

12. The liquid ring pump defined in claim 9 wherein the variable flow control means comprises:

sensor means for sensing the operating parameter.

13. A system comprising:

the liquid ring pump defined in claim 9; and separator means for separating gas discharged by the pump from seal liquid discharged by the pump.

14. The system defined in claim 13 wherein the variable flow control means uses seal liquid separated by the separator.

15. The system defined in claim 14 wherein the variable flow control means comprises:

a seal liquid conduit from the separator to the sweep portion of the pump; and adjustable valve means for controlling seal liquid flow in the conduit.

16. The system defined in claim 15 wherein the variable flow control means further comprises:

sensor means for sensing the operating parameter of the pump; and valve control means responsive to the sensor means for adjusting the adjustable valve.

17. Liquid ring pump apparatus comprising:

a liquid ring pump;

a source of pressurized seal liquid; and means for admitting seal liquid to a sweep portion of the liquid ring pump from the source at a rate that is actively controlled to vary based on a variable operating parameter of the pump.

18. The apparatus defined in claim 17 wherein the means for admitting seal liquid comprises:

a seal liquid conduit from the source to the sweep portion of the pump; and an adjustable valve means for controlling seal liquid flow in the conduit.

19. The apparatus defined in claim 18 wherein the means for admitting seal liquid further comprises:

sensor means for sensing the operating parameter of the pump; and valve control means responsive to the sensor means for adjusting the adjustable valve.

20. The apparatus defined in claim 19 wherein the operating parameter sensed by the sensor means is selected from the group consisting of pressure of the seal liquid admitted by the means for admitting seal liquid, pressure of gas inlet to the pump, pressure of gas discharged by the pump, operating speed of the pump, temperature of gas inlet to the pump, temperature of gas discharged by the pump, and combinations thereof.

21. The apparatus defined in claim 17 wherein the source comprises:

separator means for separating gas discharged by the pump from seal liquid discharged by the pump.

22. The apparatus defined in claim 17 wherein the source comprises:

an external source of seal liquid at a substantially constant pressure.

* * * * *